United States Patent [19]

Shapiro et al.

[11] Patent Number: 5,038,705

[45] Date of Patent: Aug. 13, 1991

[54] WARNING STAY-GUARD

[76] Inventors: Louise M. Shapiro; Brian S. Gunn, both of 716 Pennington St., Elizabeth, N.J. 07202

[21] Appl. No.: 623,060

[22] Filed: Dec. 6, 1990

[51] Int. Cl.[5] ..... G01D 21/00; H01B 7/24

[52] U.S. Cl. ..... 116/209; 52/147; 174/136

[58] Field of Search ..... 40/316; 52/147; 116/209, DIG. 33; 138/104, 121; 174/136

[56] References Cited

U.S. PATENT DOCUMENTS

| | | | |
|---|---|---|---|
| 3,009,437 | 11/1961 | Hollinger et al. | 116/209 |
| 3,251,161 | 5/1966 | Stirn | 52/147 |
| 3,362,115 | 1/1968 | Nyhus et al. | 52/147 |
| 3,926,141 | 12/1975 | Taylor | 116/209 |
| 4,135,336 | 1/1979 | Bogese, II | 52/147 |
| 4,813,369 | 3/1989 | Moreland | 116/173 |
| 4,967,799 | 11/1990 | Bradshaw et al. | 138/121 |

FOREIGN PATENT DOCUMENTS

| | | | |
|---|---|---|---|
| 0284773 | 10/1966 | Australia | 116/209 |
| 0040122 | 6/1968 | Finland | 52/147 |

*Primary Examiner*—William A. Cuchlinski, Jr.
*Assistant Examiner*—W. Morris Worth
*Attorney, Agent, or Firm*—William T. Hough

[57] ABSTRACT

In a preferred embodiment, to prevent accidental tripping on a stay, the warning stay-guard as an open-ended hollow tubular casing has its outer surface visibly exhibiting multiple bright colors randomly heterogeneously distributed in the nature of string and/or drippings of various paints, and the casing surface including outer ringed-construction around it longitudinal axis to the casing's construction sufficiently to diffuse light and having a linearly extending slit axially extending substantially parallel to the longitudinal length axis of the tubular casing enabling pressing upon a stay through the slit when held open.

6 Claims, 2 Drawing Sheets

WARNING STAY-GUARD

This invention is directed to a safety hazard-warning stay-guard for visibly alerting persons walking or running in the vicinity of the presence of the stay.

PRIOR ART

Prior to the present invention, for mechanism and/or objects directed to the notorious hazard of typically tent stays and/or guy wires include Hollinger et al. U.S. Pat. No. 3,009,437 disclosing an open-sided tube having spiral continuous wide fin of fluorescent dye or pigment, with a corresponding helically extending slit—noting that the spiral shape carrying the large continuous fin together with the helical slot, provides rigidity and propensity to cling to the encircled cable or tent stay, as is discussed in that patent in col. 2. Moreland U.S. Pat. No. 4,813,369 for a water-skiing tow line, provides a triangular banner of bright color together with a line-threading end-tube as a warning pennant. No other relevant patents were located with regard to the objects controlling features of the present invention.

BACKGROUND TO THE INVENTION

Prior to the present invention, there have been many injuries caused to adults, teenage boys and girls and children alike arising from stays such as rope in support of tents or badminton nets, tennis nets, sail boat mast stays, telephone pole stays, and the like, incurred by tripping. Such injuries are not only momentarily painful but can cause serious injuries by falling onto stakes, against posts, or even into or on other unsuspecting person, particularly during the heat of a game involving running and/or jumping around recklessly during the playing of the game. Also such stays during the late afternoon and/or night hours cause increased hazard even to the casual walking person of poorer visibility during such hours. While it is desirable to have some sort of alerting visual hazardous warning structure associated with such stay supports, it is also undesirable to have gaudy flags or cumbersome large and/or unattractive structures, and clearly undesirable for such warning structures to be so large as to impair being able to see beyond. In order to be accepted readily by the buying public, both attractiveness and ease of mounting are essential features, together with importance of durability in holding fast to the mounting stay holding securely to the stay support, but also being easily intermittently removable.

OBJECTS OF THE INVENTION

Accordingly, objects of the present invention include the overcoming of problems and difficulties and disadvantages of the types described above, together with achieving additional benefits as follow.

More particularly, an object of the present invention is to obtain a small but attention getting device readily detected and seen by any casual observer in the vicinity to thereby render a dangerous condition substantially less hazardous. Another object is to obtain a warning stay-guard having a novel and unique arrangements of color-combinations on uniquely shaped structure as to enhance its attention-attracting capabilities.

Another object is to obtain, a warning stay-guard having novel pigment or dye or paint configurations adapted to pleasingly attract the eye thereby avoiding hazards of associated stays.

Another object is to employ novel structure for diffusing light striking the novel color combinations and shapes thereof of the present invention, to improve the attention getting capability thereof.

Another object is to obtain in combination with one or more of the foregoing objects, a structural shape adapted to facilitate each of easy mounting, secure holding to the stay when mounted and easy removal.

Another particular object is to obtain, together with foregoing one or more objects, a high quality and/or level of ornamentation of good-taste appearance adapted to encourage purchase and use of the inventive object with a resulting reduction in notoreous hazards presently existing.

Other objects become apparent from the preceding and following disclosure.

The foregoing objects are achieved by the invention as disclosed herein.

BROAD DESCRIPTION

Everyday hazards are present in both work and play, in the presence on various objects of supporting stays thereof, typically such as volley ball nets, badminton nets, tents, sail boat masts, utility poles and the like. It is to the prevention or reducing of the likelihood of such hazards that this invention is directed, by accomplishing the foregoing objects.

It is in that sense that for the present invention a unique combination of both structure, shape of structure, color, nature of colors, and arrangement of colors there is obtained a unitary benefit of securing and holding a maximum of attention necessary for the public to either consciously or subconsciously become aware of existing hazards over which a person otherwise accidentally could trip to thereby incur an injury, perhaps serious in nature. Such objects and benefits are broadly obtained by: 1) a substantially flexible elongated tubular casing; 2) the substantially flexible elongated tubular casing having an outer brightly-colored multicolored surface; 3) the brightly-colored multicolored surface being such that it is visibly discernible from a predetermined distance therefrom; 4) the predetermined distance therefrom for visible discernment being a minimum distance sufficiently great or large for a person to avoid a stay as an impending hazard; 5) the tubular casing has an imaginary longitudinal axis extending along the predetermined elongated length for a sufficient tubular casing length for the tubular casing to substantially cover a predominant proportion of a stay-length of an axially (longitudinally) elongated stay when mounted on that typical stay—noting that a typical stay typically ranges from a minimum of about two feet to about seven feet in length, more normally ranging from about three feet to about six feet in length; 6) the tubular casing forms enclosed channel space; 7) the tubular casing has opposite open ends in flow communication with the channel space; 8) the tubular casing has a substantially linear through-space slit; 8) the through-space slit extending lineally and axially (longitudinally) along the longitudinal axis with the tubular casing having slit-forming walls shaped and positioned to retain the slit in a normally substantially closed state and position; 9) The substantially closed state of the slit-forming walls of the substantially flexible elongated tubular casing is such that the tubular casing is easily mountable on a lineally extending typically taut stay that can be readily sidewardly slid or inserted through the opened slit in an opened state, into the lineally axially-extending channel space when the slit is intermittently opened along its longitudinal axis; 10) when the flexible elongated tubular casing is mounted on a stay, the slit-forming walls are exertable of a retaining pressure on a mounted stay, tending to deter the tubular casing from accidentally slipping from the channel space to thereby prevent the tubular casing from accidentally falling-off of a mounted stay; 11) Likewise, there is concurrently achieved the result that the tubular casing does not readily accidentally slip-off of the stay by virtue of the fact that the slit of the tubular casing of this invention is not normally an open slit; 12) the tubular casing with its flexible walls and slit-forming walls thereof may be easily and speedily stripped from the stay; and 13) the axially extending linear slit permits the speedy and easy removal without entanglement with the stay or without necessity of detachment of fasteners and without the necessity of unwinding from the stay, whereby removal of the present combination is devoid of substantial wear and tear on the tubular casing. As a result of the novel combination of all of the foregoing features, in this broad embodiment, persons may reliably be visually alerted to the hazardous presence of the stay by the uniquely shaped and brightly-colored multicolored surface of the flexible elongated tubular casing, thereby preventing accidental injuries to persons unaware of or who overlook (forget) the presence of such stay. All of these foregoing features are considered to be critical to the obtaining minimal benefits of this invention in its broadest scope, for reasons stated above.

In a first preferred embodiment, the tubular casing has an outer multicolored surface, and the brightly colored multicolored surface includes a plurality of color-imparting compositions substantially separately positioned on the outer surface, critical to obtain the preferred attention-getting benefits.

In a second preferred embodiment as a further improvement on the first preferred embodiment, the color imparting compositions are of a variety of different and contrasting colors avoiding a solid-color appearance, having the different contrasting color compositions substantially heterogeneously randomly dispersed on the outer surface, such requirements being critical to secure maximum benefits set-forth in precedingly-stated objects.

In a third preferred embodiment, as a further preferred embodiment on the second preferred embodiment, the heterogeneously randomly dispersed compositions are applied in the form of string-like shapes and/or in the form of paint drippings (or the like) of color-imparting composition, critical to achieve the improved attention-getting benefits of the invention for this embodiment.

In a fourth preferred embodiment, as a further preferred embodiment on the third preferred embodiment, the tubular casing includes an uneven ringed surface imparting strength and flexibility thereto. As a result thereof, light striking one or more of the rings of the ringed surface, with the rings circumscribing the longitudinal axis of the tubular space, the light is diffused into numerous different directions, critically maximizing the eye-catching benefits of the brightly-colored multicolored surface of contrasting bright colors.

In a fifth preferred embodiment of the invention as a further improvement on the fourth preferred embodiment, the outer surface of the tubular casing, has a helically-extending ridge extending along the longitudinal axis around the tubular casing, critically further enhancing light reflection and diffusion by introducing the slanted helical surface as an added dimension in the art of attraction the eye of the person in the vicinity.

In a sixth preferred embodiment, the broad invention previously described includes the features of the second preferred embodiment.

In a seventh preferred embodiment, the broad invention previously described includes the features of the third preferred embodiment.

In an eighth preferred embodiment, the broad invention previously described includes the features of the fourth preferred embodiment.

In a ninth preferred embodiment, as a further improvement on the eighth preferred embodiment, there are included the features described for the fifth preferred embodiment.

While the invention is directed primarily and preferably to hazard prevention with regard to stays of the type above-noted, the inventive combination may be also beneficially utilized in the avoidance or reducing of hazards arising from other structures that pose a threat to a walking person or to entanglement in a persons feet, such as floor lamp wires or telephone wires or exposed electrical wires having frayed insulation, automobile dash-board hanging wires, and the like.

The invention may be better understood by making reference to the drawings of the following Figures.

THE FIGURES

DETAILED DESCRIPTION

In the following description of the foregoing Figures, all of the Figures illustrate a common preferred of the warning stay-guard of this invention. Accordingly, common indicia are utilized in all figures and once described for one figure, description is not be repeated for other figures except in some instances for clarity to improve ease of understanding.

Figure 1:
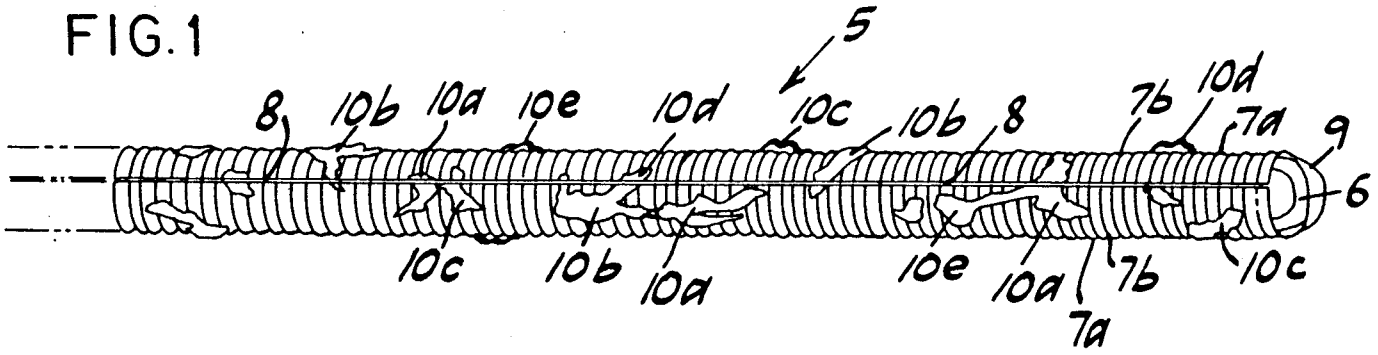
FIG. 1 is a diagrammatic perspective in-part view of the elongated warning stay-guard of the invention in a preferred embodiment.
Figure 4:
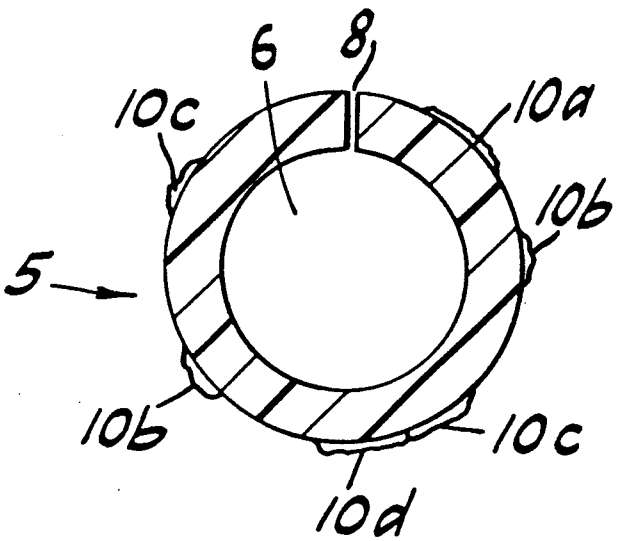
FIG. 4 is a diagrammatic cross-sectional view taken along line 4—4 of FIG. 3 for that embodiment thereof.
Figure 3:
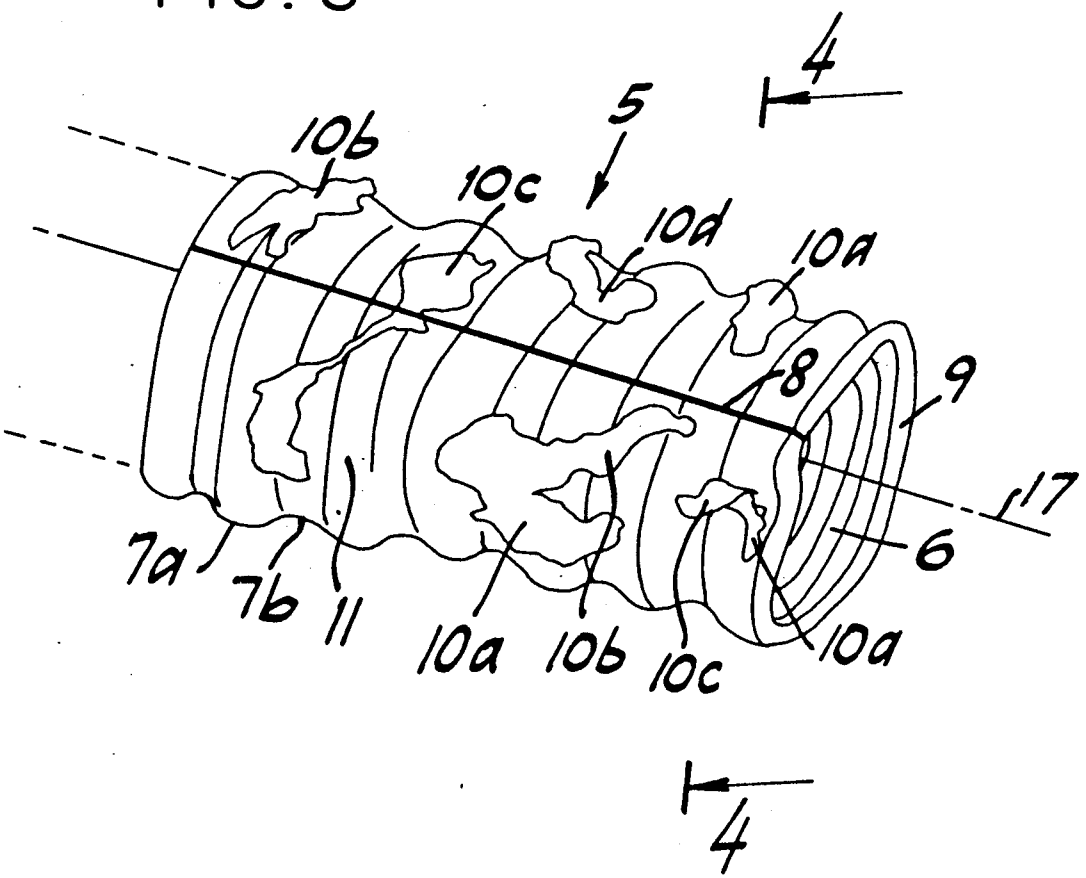
FIG. 3 is a diagrammatic perspective enlarged view of an embodiment and illustration comparable to the view of FIG. 1, better illustrating the outer multitude of colored compositions on the outer surface.

FIGS. 1 and 3 show comparable although somewhat different warning stay-guards 5 of the same preferred embodiment both in end perspective views thereof, having a tubular through-space between opposite open ends thereof—only one open end 9 thereof being illustrated with its channel space 6, the open end 9 being shown in FIGS. 1 and 3 which is identical to the opposite open end thereof. Extending along the longitudinal axis 17 thereof with its axially extending through-slit extending through the wall thickness such that the slit may be forcefully opened intermittently while applying the warning stay-guard to a stay by passing the elongated stay through the open-space of the opened slit which thereafter resiliently closes. That slit 8 is best seen in the FIG. 4 cross-sectional view. As an integral part of the typically uniformly colored surface 11 typically charcoal or black colored—but optionally some other color that is in color-contrast with other spaced-apart surface colors which arise from the surface compositions 10*a* through 10*e* of diverse different contrasting bright colors such as typically red, green, yellow, orange, blue, white, pink, and/or blends of one or more thereof, for example. In this embodiment, the outer surface of the warning stay-guard is undulating as shown, in this embodiment being a raised helical shape extending around the tube along its axially extending longitudinal axis 17 of FIG. 3.

Figure 2:
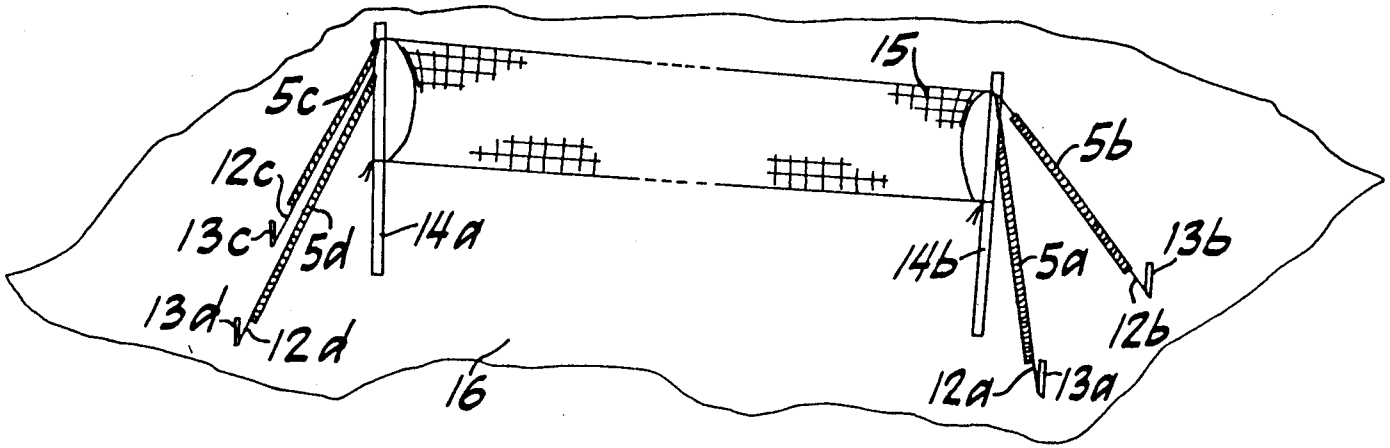
FIG. 2 is a diagrammatic perspective view of a typical prior art volley ball net and line-supports supporting the upright polls or posts having the net suspended therebetween, with the inventive warning stay-guards typically mounted on the line or stay-supports.

FIG. 2 for a volley ball net 15 broadly (devoid of detail) illustrates four separated warning stay-guards 5*a* through 5*d* mounted on four different stays 12*a* through 12*d* anchored between four different stakes 13*a* through 13*d* [in the ground] 16 and two spaced-apart volley ball net-supporting polls 14*a* and 14*b*. This figure thus illustrates a typical use of the warning stay-guards on stays over which a person would be likely to trip in the absence of the presence of the warning stay-guards.

For the present invention, the colored compositions and/or surfaces and/or the color surface 11 may any one or more thereof optionally be fluorescent, although such is not a requirement for the present invention.

The composition of the tubularly shaped warning stay-guard 5 may be any one or more of any conventional or desired material typically such as any flexible or semi-flexible and/or resilient plastic, rubber, fabric, cardboard, or the like. The colored compositions may be of the same one or more such compositions and/or paint(s) and/or dye(s) and/or pigment(s) or the like, or combinations thereof.

There are no minimum nor maximum limits on the inner and outer diameters and/or thickness of the walls of the tubular-like warning stay-guard other than dictated by practicality and by the outer diameter of the stay or other equivalent elongated object on which the warning stay-guard is to be mounted, except that the outer diameter must be sufficiently large as to be reasonably discernibly visible sufficiently to alert a person in the vicinity as to the fact of the presence of the warning stay-guard so as to avoid there being a tripping hazard caused by the stay. As to thickness, the thickness may vary considerably, requiring solely that the tube be not too flimsy so that the normally-closed slit 8 will adequately cause the warning stay-guard to cling to the stay on which it is mounted. Typically, the warning stay-guard 5 has an inner diameter of about one centimeter (10 millimeters) and an outside diameter of 1.2 centimeters (12 millimeters). Accordingly, the thickness is typically about 1 millimeter, more or less, depending upon the rigidity and strength of the composition out of which the warning stay-guard is formed.

It is within the scope of the present invention to make variation(s) and/or modification(s) and/or substitution(s) of equivalent(s) within ordinary skill of the art.

We claim:

1. A warning stay-guard consisting of: a substantially flexible elongated tubular casing having an outer brightly-colored multicolored surface visibly discernible from a predetermined distance therefrom sufficiently to avoid a stay as an impending hazard and having a predetermined elongated length, the outer brightly-colored multicolored surface including an outer circumscribing surface having a plurality of different-colored color-imparting compositions of different contrasting colors substantially positioned thereon and heterogeneously randomly dispersed on said outer surface, the tubular casing having a longitudinal axis extending along said predetermined elongated length sufficient in length for the tubular casing to substantially cover a predominant proportion of stay-length of an axially elongated stay when mounted thereon and forming enclosed channel space extending along the longitudinal axis and having opposite open ends in flow communication with the channel space and having a substantially linear through-space slit axially extending substantially lineally along said longitudinal axis with the tubular casing having slit-forming walls shaped and positioned to retain the slit in a substantially closed state and position sufficiently such that the tubular casing is easily mountable on a stay insertable into the channel space only when the slit is flexibly intermittently opened along its longitudinal axis and such that when mounted on a stay said slit-forming walls are exertable of a retaining pressure on a mounted stay tending to deter the tubular casing from accidentally slipping from the channel space thereby preventing the tubular casing from accidentally falling-off of a mounted stay, whereby persons may reliably be visually alerted to the hazardous presence of the stay by the brightly-multicolored surface.

2. A warning stay-guard of claim 1, in which said heterogenously randomly dispersed compositions are applied in the form of at-least one of strings and drippings of color-imparting composition.

3. A warning stay-guard of claim 2, in which said tubular casing includes an uneven ringed surface imparting strength and flexibility thereto, said ringed surface including rings circumscribing said longitudinal axis.

4. A warning stay-guard of claim 3, in which the tubular casing includes as a part of said outer surface a helical ridge extending along said longitudinal axis around the outer surface of the tubular casing.

5. A warning stay-guard of claim 1, in which said tubular casing includes an uneven ringed surface imparting strength and flexibility thereto.

6. A warning stay-guard of claim 5, in which the tubular casing includes as a part of said outer surface a helical ridge extending along said longitudinal axis around the outer surface of the tubular casing.

* * * * *